US006856124B2

(12) United States Patent
Dearn et al.

(10) Patent No.: US 6,856,124 B2
(45) Date of Patent: Feb. 15, 2005

(54) LDO REGULATOR WITH WIDE OUTPUT LOAD RANGE AND FAST INTERNAL LOOP

(75) Inventors: David Dearn, Malmesbury (GB); John Stuart Malcolm, Headley Hants (GB); Axel Pannwitz, Lenningen (DE)

(73) Assignee: Dialog Semiconductor GmbH, Kirchheim/Teck-Nabern (DE)

( * ) Notice: Subject to any disclaimer, the term of this patent is extended or adjusted under 35 U.S.C. 154(b) by 201 days.

(21) Appl. No.: 10/191,849

(22) Filed: Jul. 9, 2002

(65) Prior Publication Data

US 2004/0004468 A1 Jan. 8, 2004

(30) Foreign Application Priority Data

Jul. 5, 2002 (EP) ..... 02368074

(51) Int. Cl.[7] ..... G05F 1/40
(52) U.S. Cl. ..... 323/280; 323/273
(58) Field of Search ..... 323/280, 281, 323/282, 283, 284, 285, 286, 288

(56) References Cited

U.S. PATENT DOCUMENTS 5,631,598 A 5/1997 Miranda et al. ..... 327/540
5,686,821 A * 11/1997 Brokaw ..... 323/272
5,966,004 A 10/1999 Kadanka ..... 323/271
6,046,577 A 4/2000 Rincon-Mora et al. ..... 323/282
6,188,212 B1 * 2/2001 Larson et al. ..... 323/281
6,225,857 B1 5/2001 Brokaw ..... 327/540
6,246,221 B1 * 6/2001 Xi ..... 323/280
6,304,131 B1 10/2001 Huggins et al. ..... 327/538
6,340,918 B2 1/2002 Taylor ..... 330/292
6,518,737 B1 * 2/2003 Stanescu et al. ..... 323/280

* cited by examiner

*Primary Examiner*—Rajnikant B. Patel
(74) *Attorney, Agent, or Firm*—George O. Saile; Stephen B. Ackerman

(57) ABSTRACT

A method and a circuit to achieve a low drop-out voltage regulator with a wide output load range has been achieved. A fast loop is introduced in the circuit. The circuit is internally compensated and uses a capacitor to ensure that the internal pole is more dominant than the output pole as in standard Miller compensation. The quiescent current is set being proportional to the output load current. No explicit low power drive stage is required. The whole output range is covered by one output drive stage. By that means the total consumption of quiescent or wasted current is reduced. An excellent PSRR is achieved due to load dependent bias current.

23 Claims, 4 Drawing Sheets

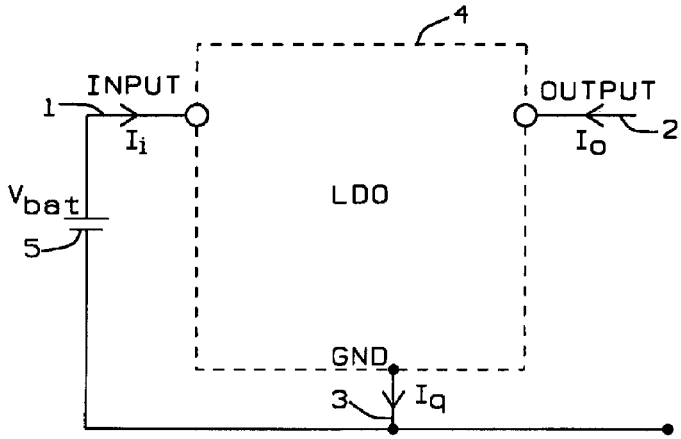
FIG. 1 – Prior Art
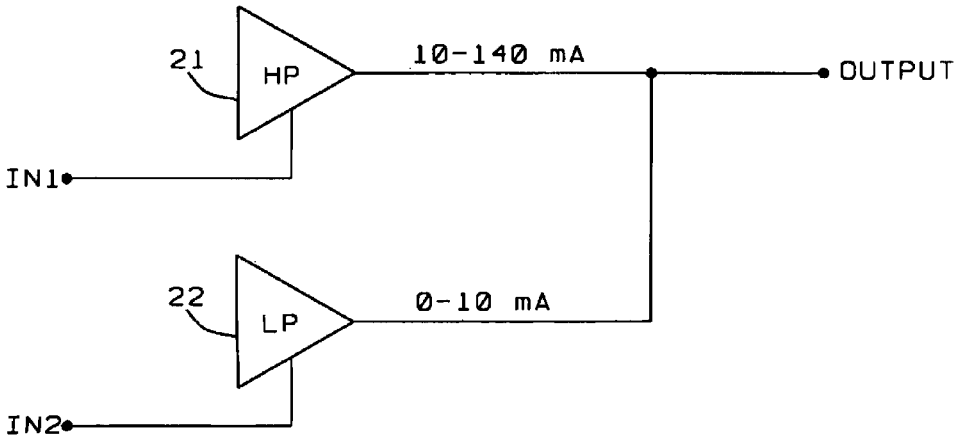
FIG. 2 – Prior Art

LDO REGULATOR WITH WIDE OUTPUT LOAD RANGE AND FAST INTERNAL LOOP

BACKGROUND OF THE INVENTION (1) Field of the Invention

This invention relates generally to voltage regulators, and more particularly to a low drop-out (LDO) voltage regulator having from zero to full load a low quiescent current, no explicit low power mode and an excellent PSRR due to load dependent bias current.

(2) Description of the Prior Art

Low-dropout (LDO) linear regulators are commonly used to provide power to low-voltage digital circuits, where point-of-load regulation is important. In these applications, it is common for the digital circuit to have different modes of operation. As the digital circuit switches from one mode of operation to another, the load demand on the LDO can change quickly. This quick change of load results in a temporary glitch of the LDO output voltage. Most digital circuits do not react favourably to large voltage transients. An important goal for voltage regulators is to isolate sensitive circuitry from the transient voltage changes of the battery.

The PSSR of the voltage regulator significantly reduces the supply transient seen by the phone circuits. Applications requiring power from LDO voltage regulators are becoming more sensitive to noise as frequency and application bandwidth are constantly increased. Therefore power supply ripple rejection (PSRR) characteristics are extremely important associated with LDO voltage regulators.

Conventional LDO regulators are very problematic in the area of transient response. The transient response is the maximum allowable output variation for a load current step change and must be frequency compensated in order to ensure a stable output voltage. Conventional means to compensate frequency dependencies are limiting the load regulation performance and the accuracy of the output.

A low quiescent or ground current is important for the efficiency of a LDO voltage regulator. FIG. 1 prior art shows the principle currents of such a LDO regulator 4 regulating the battery voltage Vbat 5. The quiescent current Iq 3 is the difference between the input current Ii 1 and output current Io 2:

$$Iq=Ii-Io.$$

Quiescent current consists of bias current (such as bandgap reference, sampling resistor, and error amplifier currents) and the gate drive current of the series pass element, which do not contribute to output power. The value of quiescent current is mostly determined by the series pass element, topologies, ambient temperature, etc.

In prior art an extra low power mode is often introduced to cover a wide output load range. FIG. 2 prior art illustrates a typical embodiment of the driver stages of such a solution. There is one driver stage for high power 21 covering an output load range e.g. from 10 mA to 140 mA. Additionally there is another driver stage for low power 22 covering an output load range from 0 mA to 10 mA. The quiescent or wasted current of the low power driver stage is relatively low but said quiescent current of the high power driver stage is typically in the order of magnitude of 100 $\mu$A. This means that at output currents above 10 mA up to 1% of the output current is wasted. Another problem is the switching required with every change from one power mode to another exposing sensitive circuits to potential malfunctions.

U.S. Pat. No. (6,246,221 B1 to Xi) describes a high power supply ripple rejection (PSRR) internally compensated low drop-out (LDO) voltage regulator using an output PMOS pass device. The voltage regulator uses a non-inversion variable gain amplifier stage to adjust its gain in response to a load current passing through the output PMOS device such that as the load current decreases, the gain increases, wherein a second pole associated with the voltage regulator is pushed above a unity gain frequency associated with the voltage regulator.

U.S. Pat. No. (6,304,131 B1 to Huggins et al) discloses a high power supply ripple rejection internally compensated low drop-out (LDO) voltage regulator using an output PMOS pass device. The voltage regulator uses an intermediate amplifier stage configured from a common source, current mirror loaded PMOS device to replace the more conventional source follower impedance buffer associated with conventional Miller compensation techniques. Compensation is achieved through the use of a small internal capacitor that provides a very low frequency dominant pole at the output of the input stage.

U.S. Pat. No. (6,340,918 B2 to Taylor et al.) shows a frequency compensation of multi-stage amplifiers circuits. Particularly, but not exclusively, the invention provides a frequency compensation scheme for negative feedback amplifiers circuits such as voltage regulators, and in particular for low drop-out (LDO) regulators. An amplifier circuit comprises a first amplifier stage controlling a second gain stage which is coupled between a voltage input node and an output node. A frequency compensating circuit is coupled between a compensating circuit node of the gain stage and a control input of the gain stage.

SUMMARY OF THE INVENTION

A principal object of the present invention is to provide a circuit for a low drop-out (LDO) voltage regulator having a wide range from zero to full load with a low quiescent current.

A further object of the present invention is to provide a circuit for a low drop-out voltage regulator without the requirement of switching due to load changes.

A further object of the present invention is to achieve a circuit for a low drop-out (LDO) voltage regulator without an explicit low power mode.

Another further object is to achieve an excellent power supply ripple rejection (PSRR) ratio.

In accordance with the objects of this invention a circuit for a low drop-out voltage regulator with a wide output load range without an explicit low power stage is achieved. Said circuit is comprising, first, a slow loop comprising a differential amplifier stage, wherein the quiescent current is varied by the magnitude of the output load current, having an input and an output wherein the input is a voltage out of a voltage divider and the output is a input of a fast loop. Furthermore the circuit comprises a voltage divider hooked up between ground and the drain of a output transistor and a fast loop comprising a capacitor, hooked up between the drain of said output transistor and the output of said amplifier stage of the slow loop, an amplifier stage having an input and an output, wherein the input is the output of the said amplifying stage of said slow loop and the output is the input of an output drive stage, an output drive stage, wherein the gain of said output drive stage is varied by the magnitude of the output load current, having an input and an output, wherein the input is the output of said amplifier stage and the output is the input of an output transistor; and an output transistor having an input and an output, wherein the input is the output of said output drive stage and an unregulated battery voltage and the output is a load current being connected said slow loop and said fast loop.

In accordance with further objects of the invention a method to achieve a regulated voltage with a wide output load range without an explicit low power stage and with an excellent PSRR providing a slow loop comprising a differential amplifier stage and a voltage divider, a fast loop comprising a capacitor, an amplifier stage and an output drive stage and an output transistor is achieved. The first step is to determine magnitude of the output load current and the second step is to set the quiescent current of amplifying components of the circuit proportional to the output current.

In accordance with further objects of the invention a method to achieve a regulated voltage with a wide output load range without an explicit low power stage and with an excellent PSRR providing a slow loop comprising a differential amplifier stage and a voltage divider, a fast loop comprising a capacitor, an amplifier stage and an output drive stage and an output transistor is achieved. The first step is to determine if the output load current is changing. If no change of the output load current has happened said determination is repeated. If said output current is decreasing the output pole is decreased, the output transistor pole is decreased, the pole of amplifier and capacitor is decreased, the quiescent current of amplifying components of the circuit is set proportional to the output current and the determination if the output current has changed is repeated again. If said output current is increasing the output pole is increased, the output transistor pole is increased, the pole of amplifier and capacitor is increased, the quiescent current of amplifying components of the circuit is set proportional to the output current and the determination if the output current has changed is repeated again.

BRIEF DESCRIPTION OF THE DRAWINGS

In the accompanying drawings forming a material part of this description, there is shown:

FIG. 1 prior art illustrates the principal currents of a LDO circuit.

FIG. 2 prior art shows a typical embodiment of the output driver stage of an LDO having a wide output range.

DESCRIPTION OF THE PREFERRED EMBODIMENTS

The preferred embodiments disclose a circuit for a low drop-out (LDO) voltage regulator with a wide output load range and a fast internal loop The load range from zero to full load is achieved with a low quiescent current and without an explicit low power mode. The percentage of the quiescent current compared to the output current is constant through the total load range. Additionally an excellent power supply rejection rate (PSRR), due to load dependent bias current, is achieved.

Figure 3:
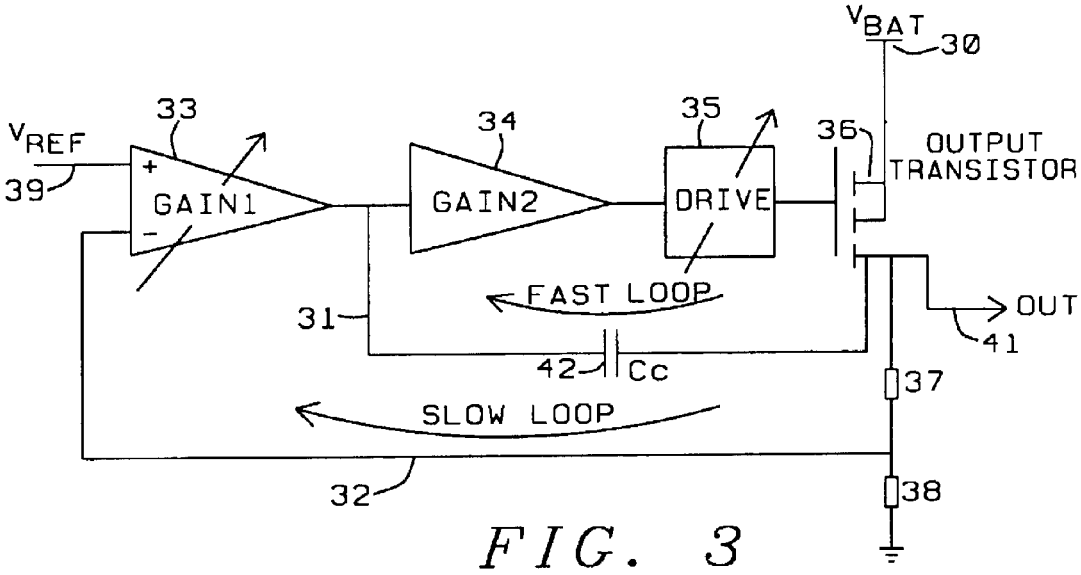
FIG. 3 shows the basic architecture of the circuit invented.

FIG. 3 shows the basic architecture of the circuit invented. The LDO circuit has a fast internal loop 31, a slow loop 32, an amplifier 33 for the slow loop, an amplifier for the fast loop 34, a drive stage 35, an output transistor 36, a voltage divider comprising the resistors 37 and 38, a reference voltage Vref 39, an unregulated battery voltage Vbat 30, an output voltage 41 and a Miller capacitor Cc 42. The quiescent current of said amplifier 33 for the slow loop and the quiescent current of said drive stage 35 is varied with the magnitude of the output load current.

The circuit is internally compensated and uses the Miller capacitor Cc 42 to ensure the internal pole is more dominant than the output pole as in standard Miller compensation. However, one main idea of the invention is to increase the gain of the amplifier 34 and of the drive stage 35 as much as possible, providing the fast loop 31 in it's own right remains stable. In this way the power supply rejection ratio (PSRR), the load and line performance can be increased well beyond the traditional unit gain bandwidth of the slow loop 32.

In order to achieve said increase of the gain of the amplifier 34 and of the drive stage 35 the next dominant pole (that of the gate capacitance of the output transistor 36) must be moved beyond the unity gain bandwidth of the fast loop. This is only possible with a large quiescent current in the drive stage 35.

Typically a high PSRR and load and transient line performance is only required at large output currents while at low output currents the high performance is less important.

Figure 4:
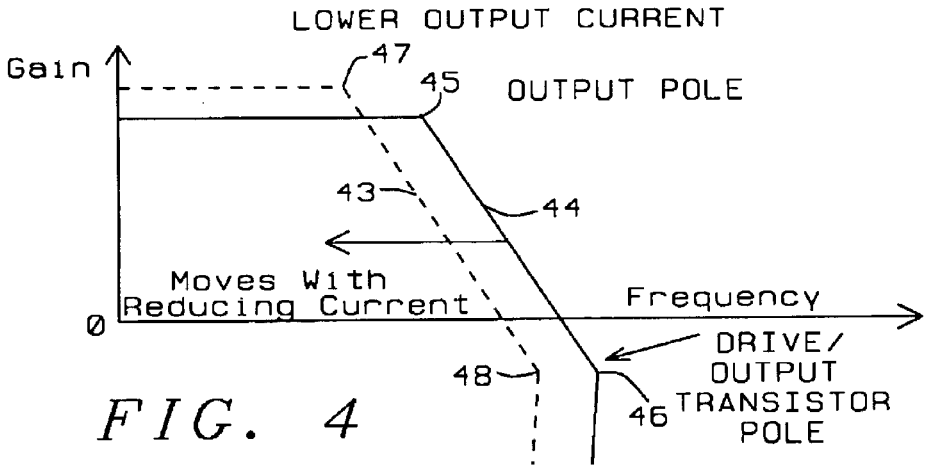
FIG. 4 shows how the poles of the circuit are depending from the output current.

FIG. 4 shows principally that the pole formed with the output transistor decreases, as the output load pole decreases, still keeping the fast loop stable. In FIG. 4 the dotted line 43 represents a reduced load current situation, the solid line 44 shows a high load current situation. The edge 45 in the solid line 44 represents said output pole, the other edge 46 in the solid line 44 represents said output transistor pole in a high output current situation. The edges 47 and 48 represent the correspondent output poles in a reduced current situation.

In order to keep the whole regulator stable (not the fast loop only) the pole formed by said the Miller capacitor Cc must be dominant. The unit gain bandwidth of the slow loop, which is the unit gain bandwidth of the complete regulator) is $$Gu = \frac{g_m(gain1)}{Cc}$$

wherein Gu is said unit gain bandwidth, gm(gain1) is the gain or the relation of the voltage to current of amplifier 33 of FIG. 3.

It is possible to set said unit gain bandwidth Gu very low so that the slow loop or the complete regulator remains stable, however, for better performance said gain gm(gain1) of the amplifier 33 shown in FIG. 3 can also be varied as the output current falls. This means effectively that as the output current falls, and hence the output pole falls, then not only does the drive/output transistor pole fall, keeping the fast loop stable but also the gain1/Cc pole falls as the output current falls, keeping the whole regulator stable.

The fact that lower quiescent current is used as the output current falls means that a specific low power mode is not required. This is advantageous because there is no need anymore to estimate when to go into a low power mode and because over all less quiescent current is required and any switching between power modes is no more required.

Figure 5:
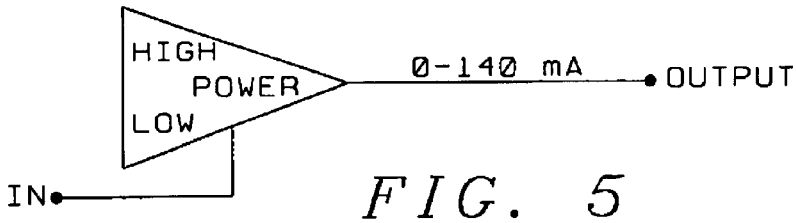
FIG. 5 illustrates that the circuit invented requires one output drive stage only.

FIG. 5 shows that in contrast to FIG. 2 prior art the specific driver stage for low power is no more required. The quiescent or wasted current is variable depending on the output load and is constantly in the order of magnitude of 0.5%. This means that at higher load where more quiescent current is needed, it can be supplied but at lower load, where it is not required, it is not wasted. The driver stage of the invention can manage efficiently e.g. a load range from 0 to 140 m as a single driver stage.

Figure 6:
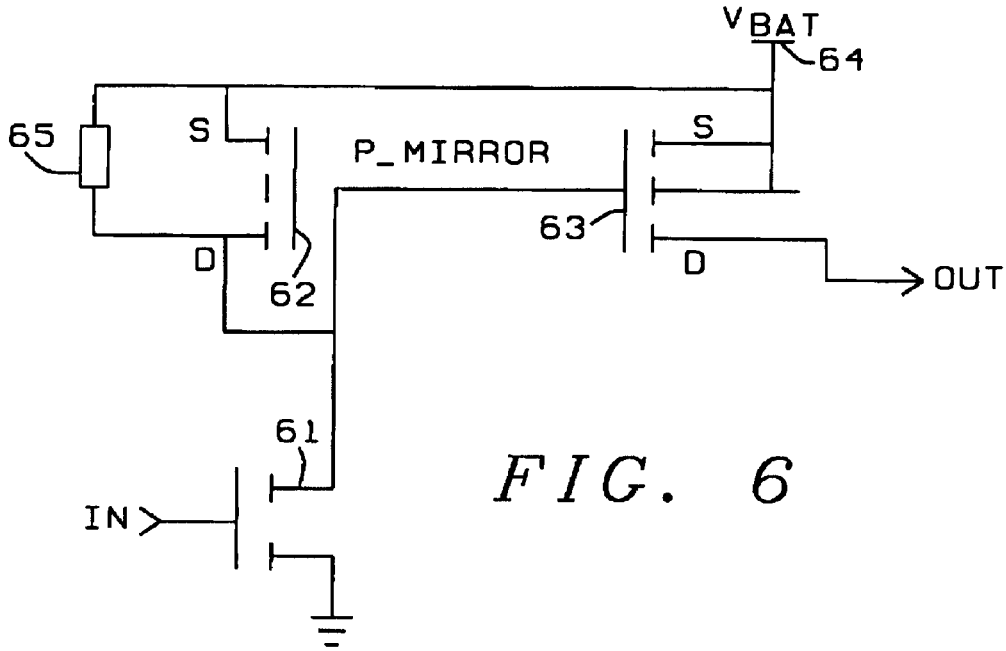
FIG. 6 shows an embodiment of the output transistor drive stage.

FIG. 6 shows the layout of the output transistor drive stage. Said drive stage comprises an entry transistor 61, a MOS transistor with bulk contact as P-current mirror 62, a MOS transistors with bulk contact as P-drive 63, a battery voltage 64 and a resistor 65. Said resistor, having in an embodiment e.g. a resistance of 1 MΩ, prevents the impedance of the drain of the P-mirror 65 being infinite. In order to drive the gate capacitance of the P-drive transistor 63, a current mirror is used. Said current mirror has both low drive impedance and the advantage that the drive current used is proportional to the output current. For those skilled in art it is obvious that instead of p-channels n-channels could be used as well.

Figure 7:
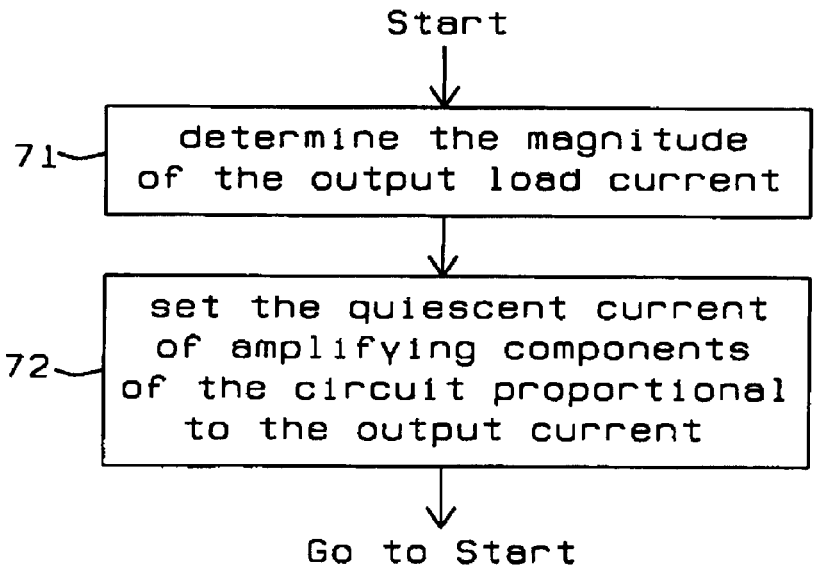
FIG. 7 shows a principal method how the quiescent current is set proportional to the output load current.

FIG. 7 shows a principal method of how to achieve a regulated voltage with a wide output load range without an explicit low power stage and with a low quiescent current on average. Step 71 illustrates that the magnitude of the output load current is used to set in step 72 the quiescent current of the major amplifying components of the circuits proportional to the output current. In one embodiment the quiescent current of the amplifier of the slow loop and of the output drive stage has been set proportional of the output current.

Figure 8:
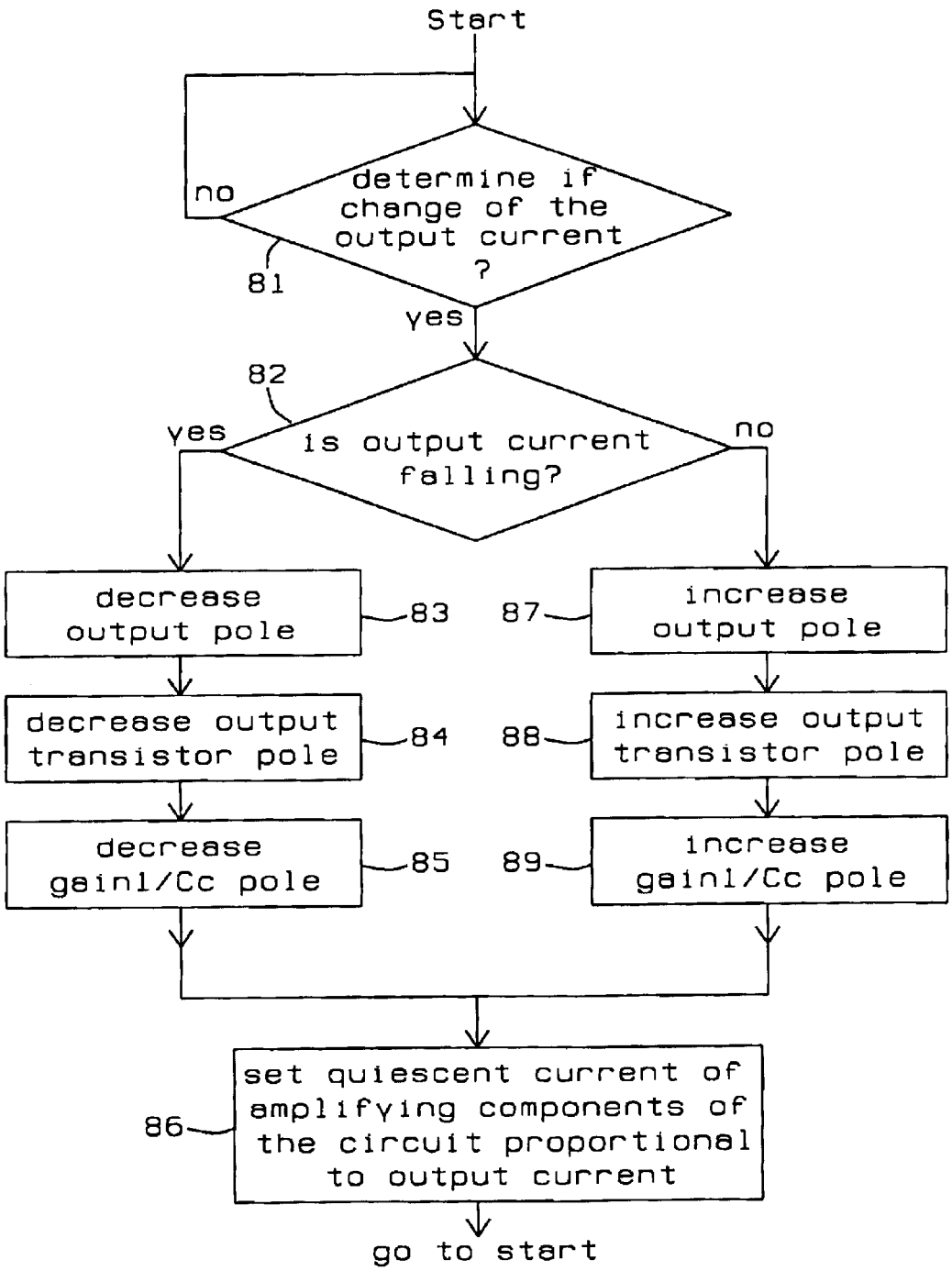
FIG. 8 shows a flowchart of the method illustrating how the quiescent current is set.

FIG. 8 illustrates a method how to achieve a wide output load range without an explicit low power mode drive stage with low quiescent current. The first step 81 comprises the determination if the output current has changed. If no change has happened the determination of any change of the output current is repeated. Step 82 comes into action if the output current has changed. In case the output current has decreased then in step 83 the output pole is decreased, subsequently in step 84 the output transistor pole is decreased, subsequently in step 85 the gain1/Cc pole is decreased and furthermore in step the quiescent current is set proportional to the output current. With the final step 87 the whole sequence of the method is repeated.

In case of an increasing current in step 82, the output pole is increased in step 87, subsequently the output transistor pole is increasing in step 88, subsequently the gain1/Cc pole is increasing in step 89 and finally the quiescent current is set proportional to the output current in step 86. With the final step 86 the whole sequence of the process is repeated.

While the invention has been particularly shown and described with reference to the preferred embodiments thereof, it will be understood by those skilled in the art that various changes in form and details may be made without departing from the spirit and scope of the invention.

What is claimed is:

1. A circuit to achieve an low drop-out voltage regulator with a wide output load range without an explicit low power stage comprising:

a slow loop comprising a differential amplifier stage, wherein the quiescent current is varied by the magnitude of the output load current, having an input and an output wherein the input is a voltage out of a voltage divider and the output is a input of a fast loop;

a voltage divider hooked up between ground and the drain of an output transistor;

a fast loop comprising:

a capacitor, hooked up between the drain of said output transistor and the output of said amplifier stage of the slow loop;

an amplifier stage having an input and an output wherein the input is the output of the said amplifying stage of said slow loop and the output is the input of an output drive stage;

an output drive stage, wherein the gain of said output drive stage is varied by the magnitude of the output load current, having an input and an output wherein the input is the output of said amplifier stage and the output is the input of an output transistor and wherein said output of said output drive stage comprises a drain of a first MOS transistor and wherein said drain is further connected to a source of said first MOS transistor through a resistor; and an output transistor having an input and an output wherein the input is the output of said output drive stage and an unregulated battery voltage and the output is a load current being connected said slow loop and said fast loop.

2. The circuit of claim 1 wherein said voltage divider is a string of two resistors.

3. The circuit of claim 1 wherein a MOS transistor with a bulk contact is used as said output transistor.

4. The circuit of claim 3 wherein said MOS transistor is a PMOS transistor.

5. The circuit of claim 3 wherein said MOS transistor is a NMOS transistor.

6. The circuit of claim 1 wherein a bipolar transistor is used as said output transistor.

7. The circuit of claim 6 wherein said bipolar transistor is a PNP bipolar transistor.

8. The circuit of claim 6 wherein said bipolar transistor is a NPN bipolar transistor.

9. The circuit of claim 1 wherein said first MOS transistor of said output drive stage has a bulk contact.

10. The circuit of claim 1 wherein said first MOS transistor of said output drive stage is a PMOS transistor.

11. The circuit of claim 1 wherein said first MOS transistor of said output drive stage is a NMOS transistor.

12. The circuit of claim 1 wherein said source of said first MOS-transistor of said output drive stage is connected to the source of the output transistor, the gates of both said transistors are interconnected and further comprising an input transistor is connected to a gate and said drain of said first MOS transistor of said output driving stage and a gate of said output transistor.

13. A method to achieve a regulated voltage with a wide output load range without an explicit low power stage and with an excellent PSRR comprising:

providing a slow loop comprising a differential amplifier stage and a voltage divider, a fast loop comprising a capacitor, an amplifier stage and an output drive stage and an output transistor wherein said output drive stage comprises a first MOS transistor having drain and source connected through a resistor and wherein said first MOS transistor drain drives said output transistor;

determine if the output load current is changing;

if no change of the output load current has happened repeat said determination;

if said output current is decreasing;

decrease the output pole;

decrease output transistor pole;

decrease pole of amplifier and capacitor pole;

set quiescent current of amplifying components of the circuit proportional to output current;

go back to determine if the output current has changed; if said output current is increasing;

increase the output pole;

increase output transistor pole;

increase pole of amplifier and capacitor pole;

set quiescent current of amplifying components of the circuit proportional to output current; and go back to determine if the output current has changed.

14. The method of claim 13 wherein the quiescent current of the output drive stage is set proportional to the output load current.

15. The method of claim 13 wherein the quiescent current of the differential amplifier of the slow loop is set proportional to the output current.

16. The method of claim 13 wherein the quiescent current of the differential amplifier of the slow loop and the quiescent current of the output drive stage are set proportional to the output current.

17. The method of claim 13 wherein a MOS transistor with a bulk contact is used as said output transistor.

18. The method of claim 17 wherein said MOS transistor is a PMOS transistor.

19. The method of claim 17 wherein said MOS transistor is a NMOS transistor.

20. The method of claim 13 wherein a bipolar transistor is used as said output transistor.

21. The method of claim 20 wherein said bipolar transistor is a PNP bipolar transistor.

22. The method of claim 20 wherein said bipolar transistor is a NPN bipolar transistor.

23. The method of claim 17 wherein the source of said first MOS-transistor used as a current mirror is connected to the source of the output transistor, the gates of both said transistors are interconnected and further comprising an input transistor connected to a gate and said drain of said first MOS transistor of said output driving stage and a gate of said output transistor.

* * * * *

UNITED STATES PATENT AND TRADEMARK OFFICE

CERTIFICATE OF CORRECTION

PATENT NO. : 6,856,124 B2 
DATED : February 15, 2005
INVENTOR(S) : David Dearn, John Stuart Malcolm and Axel Pannwitz It is certified that error appears in the above-identified patent and that said Letters Patent is hereby corrected as shown below:

Title page,
Item [30], Foreign Application Priority Data, delete "02368074" and replace with -- 02368074.7 --.

Signed and Sealed this

Thirty-first Day of May, 2005

JON W. DUDAS
*Director of the United States Patent and Trademark Office*